US007150307B1

(12) United States Patent
Goettsch

(10) Patent No.: US 7,150,307 B1
(45) Date of Patent: Dec. 19, 2006

(54) LOST FOAM CASTING APPARATUS AND METHOD FOR CREATING HOLLOW GATING

(75) Inventor: David D. Goettsch, Shelby Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/196,541

(22) Filed: Aug. 3, 2005

(51) Int. Cl.
*B22C 9/04* (2006.01)

(52) U.S. Cl. ..... 164/34; 164/35

(58) Field of Classification Search ..... 164/12, 164/16, 34–36
See application file for complete search history.

(56) References Cited

U.S. PATENT DOCUMENTS 4,828,006 A * 5/1989 Vander Jagt ..... 164/34
6,619,373 B1 9/2003 Tooley et al.

FOREIGN PATENT DOCUMENTS

JP 1-127138 * 5/1989

* cited by examiner

*Primary Examiner*—Kuang Y. Lin
(74) *Attorney, Agent, or Firm*—Charles H. Ellerbrock

(57) ABSTRACT

A method and apparatus is disclosed for forming a metal casting sprue for a lost foam casting process, the sprue formed in sand for receiving molten metal and directing the molten metal to a foam pattern in a mold cavity, wherein the sprue formation is facilitated by an insert having a plurality of apertures formed therein, the apertures facilitating an application of a coating to sand surrounding the insert prior to removal of the insert from the sand, and wherein the sprue facilitates a minimization of production costs and an optimization of material properties of the resultant casting.

18 Claims, 3 Drawing Sheets

LOST FOAM CASTING APPARATUS AND METHOD FOR CREATING HOLLOW GATING

FIELD OF THE INVENTION

The invention relates to lost foam casting for producing metal castings and more particularly to a method and apparatus for forming a sprue in sand for receiving molten metal and directing the molten metal to a foam pattern in a mold cavity, wherein the sprue formation is facilitated by an insert having a plurality of apertures formed therein, the apertures permitting an application of a coating to sand surrounding the insert prior to removal of the insert from the sand.

BACKGROUND OF THE INVENTION

A so-called "lost-foam" casting process is a well-known technique for producing metal castings. A fugitive, pyrolizable, polymeric, foam pattern (including casting, gating, runners, and sprue) is covered with a thin (typically in the range of 0.25–0.5 mm), gas-permeable refractory coating/skin such as mica, silica, alumina, or alumina-silicate, for example. The pattern is embedded in compacted, unbonded sand to form a mold cavity within the sand. Molten metal is then introduced into the mold cavity to melt, pyrolyze, and displace the pattern with molten metal.

Gaseous and liquid decomposition/pyrolysis products escape through the gas-permeable, refractory skin and into the interstices between the unbonded sand particles. Typical fugitive polymeric foam patterns comprise expanded polystyrene foam (EPS) for aluminum castings and copolymers of polymethylmethacrylate (PMMA) and EPS for iron and steel castings, for example.

The polymeric foam pattern is made by injecting pre-expanded polymer beads into a pattern mold to impart the desired shape to the pattern. For example, raw EPS beads (typically 0.2 to 0.5 mm in diameter) containing a blowing/expanding agent (e.g. n-pentane) are: (1) first, pre-expanded at a temperature above the softening temperature of polystyrene and the boiling point of the blowing agent; and (2) molded into the desired configuration in a steam-heated pattern mold which further expands the beads to fill the pattern mold. Complex patterns and pattern assemblies can be made by molding several individual mold segments, and then joining the mold segments by gluing, for example, to form the pattern or pattern assembly.

The filling of a "lost-foam" casting with molten metal is typically achieved with a gravity-cast or a countergravity-cast method. In a gravity-cast lost-foam process, an overhead ladle or furnace pours metal into a pouring basin and sprue which is in communication with the casting pattern. The metallostatic head in the basin and sprue is the force driving the metal into the casting pattern. In a countergravity-cast lost-foam process, an applied pressure drives the molten metal into the pattern. This pressure can be applied in the furnace vessel, which sits below the pattern, or in the pattern flask itself.

There are three categories of gating systems in gravity-cast lost-foam process which are based on the orientation of the metal front as it enters the casting pattern. These categories are top-fill, bottom-fill and side-fill gating. A top-fill gating system has the sprue and runners located above the casting pattern. This causes molten metal to flow downward against the casting foam pattern. A bottom-fill gating system has runners which are located below the casting pattern. The metal flows downward though the vertical sprue, but flows upward against the foam casting pattern. A side-fill gating has a plurality of runners along the length of a sprue and casting pattern. The vertical sprue may be flanked by two or more patterns for making multiple castings with a single pour. Typically, a side gated foam pattern has a complex metal front of varying orientations.

Bottom-fill casting is often preferred in lost foam castings. The advantage of bottom gating is a reduction in gas bubbles that make their way into the casting causing voids or porosity defects. Coatings employed during lost foam casting often cannot absorb all the foam decomposition products as quickly as they are produced. If the molten metal is above the foam, as in top-fill casting, the gas bubbles move upward through the molten metal and collect at a top surface thereof. These gas bubbles lead to subsurface void defects in the casting. If the molten metal is below the foam, as in bottom-fill casting, the gas merely collects and slows the molten metal front movement. Thus, defects are minimized when using the bottom-fill configuration.

However, disadvantages do exist when using bottom-fill, gravity cast systems. The vertical sprue required in bottom-fill casting is typically formed using a foam pattern having the shape and configuration of the desired final shape and configuration of the sprue. Thus, the molten metal must still travel through a long section of thick foam to reach the casting area. Undesirable gases are created, but are unlikely to be carried into the casting area. However, oxide films are created which travel with the molten metal into the casting resulting in a reduction of a fatigue life of the metal. Thus, it is desirable to reduce or eliminate the foam used in the sprue to optimize the material properties of the casting.

Commonly owned U.S. Pat. No. 6,619,373 B1 is incorporated herein by reference to provide additional background and provide an example of other attempts at providing a solution for the above-mentioned disadvantages.

It would be desirable to develop a method and apparatus for forming a sprue for receiving molten metal and directing the molten metal to a foam pattern in a mold cavity for a lost foam casting process used in producing metal castings, wherein the sprue facilitates a minimization of production costs and an optimization of material properties of the resultant casting.

SUMMARY OF THE INVENTION

Consistent and consonant with the present invention, a method and apparatus for forming a sprue for receiving molten metal and directing the molten metal to a foam pattern in a mold cavity for a lost foam casting process used in producing metal castings, wherein the sprue facilitates an optimization of material properties of the resultant casting, has surprisingly been discovered.

In one embodiment, the insert for forming a sprue comprises an elongate hollow stem member having a first end and a second end, the first end of the stem member adapted to abut a lost foam casting pattern, at least a portion of the stem member is formed by a porous material to facilitate passage of a fluid therethrough; and means for expelling a fluid disposed in the stem member, the means for expelling a fluid adapted to be connected to a source of resin, wherein the resin is expelled by the means for expelling a fluid and passes through the porous material of the stem member.

In another embodiment, the insert for forming a sprue comprises an elongate hollow stem member having a first end and a second end, the first end of the stem member adapted to abut a lost foam casting pattern, at least a portion of the stem member is formed by a porous material to facilitate passage of a fluid therethrough; a perforated tube member disposed in the stem member, the tube member adapted to be connected to a source of resin, wherein the resin is caused to be expelled from the tube member and passes through the porous material of the stem member; and an inlet member formed by a porous material and disposed on the second end of the stem member, the inlet member adapted to receive said tube member.

The invention also provides methods of forming a sprue.

In one embodiment, the method of forming a sprue comprises the steps of providing a formed and coated lost foam casting pattern; providing an insert for forming a sprue comprising an elongate hollow stem member with a first end and a second end, at least a portion of said stem member formed by a porous material to facilitate passage of a fluid therethrough, the insert further comprising means for expelling a fluid disposed in the stem member, the means for expelling a fluid connected to a source of resin; providing a lost foam casting flask; positioning the lost foam casting pattern and the insert in the casting flask, wherein the insert abuts the lost foam casting pattern to cooperate with the lost foam casting pattern to define a flow path for molten metal through the casting flask; providing unbonded sand and at least partially filling the casting flask with the sand and compacting the sand around the lost foam casting pattern and the insert; causing the resin to flow through the means for expelling a fluid into the insert, through the porous material, and into the sand compacted around the insert; curing the resin to create a bonded sand layer; and withdrawing the insert from the sand leaving a sprue formed in the sand, the sprue lined by the bonded sand layer.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed and illustrated, the steps presented are exemplary in nature, and thus, the order of the steps is not necessary or critical.

Figure 1:
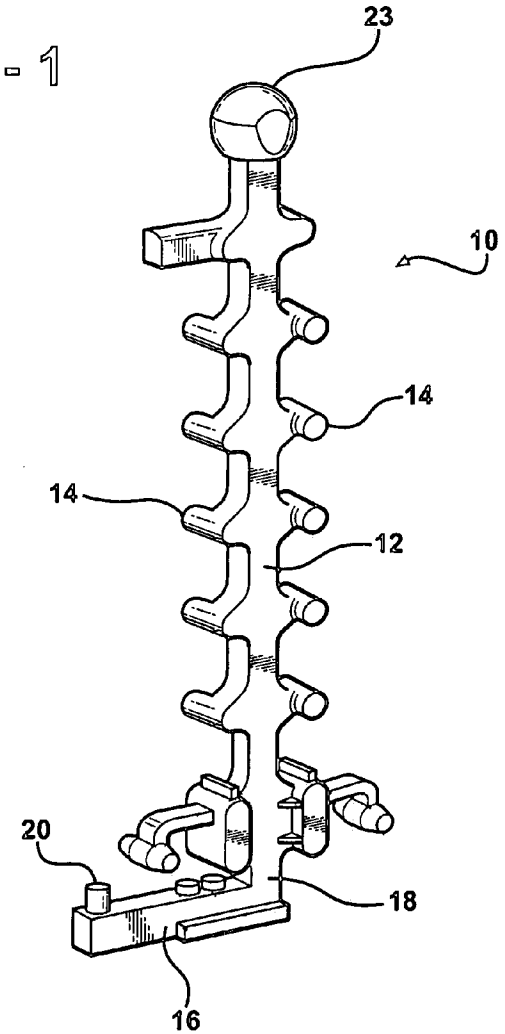
FIG. 1 is a perspective view of a typical foam casting pattern for a gating system, with the remainder of the casting pattern removed for clarity.

FIG. 1 depicts a coated lost foam casting pattern 10. Only a sprue 12 and gates 14 of the pattern 10 are shown, as the remainder of the casting pattern 10 has been omitted for clarity. The remainder of the pattern 10 can be any lost foam casting pattern such as that depicted in U.S. Pat. No. 6,619,373, for example, which has been incorporated herein by reference. A thin, gas permeable refractory material is used to coat the pattern 10 such as mica, silica, alumina, or alumina-silicate, for example, as is well known in the art. The pattern 10 can be produced by any conventional method such as by injecting pre-expanded polymer beads into a pattern mold (not shown) to impart the desired shape to the pattern 10. For example, raw EPS beads containing a blowing and expanding agent such as n-pentane, for example, are pre-expanded at a temperature above the softening temperature of polystyrene and the boiling point of the blowing agent. The pre-expanded beads are then molded into the pattern 10 in a heated pattern mold (not shown) which further expands the beads to fill the pattern mold. Typically, the pattern 10 is produced from an expanded polystyrene foam (EPS) for an aluminum casting and a copolymer of polymethylmethacrylate (PMMA) and EPS for an iron and a steel casting, for example.

A first end of a horizontal coated foam runner 16 is disposed on an inlet portion 18 of a first end of the sprue 12. A second end of the runner 16 is spaced horizontally from the inlet portion 18. An uncoated foam protuberance 20 is formed adjacent the second end of the runner 16. A riser 23 is disposed at a second end of the sprue 12.

Figure 2:
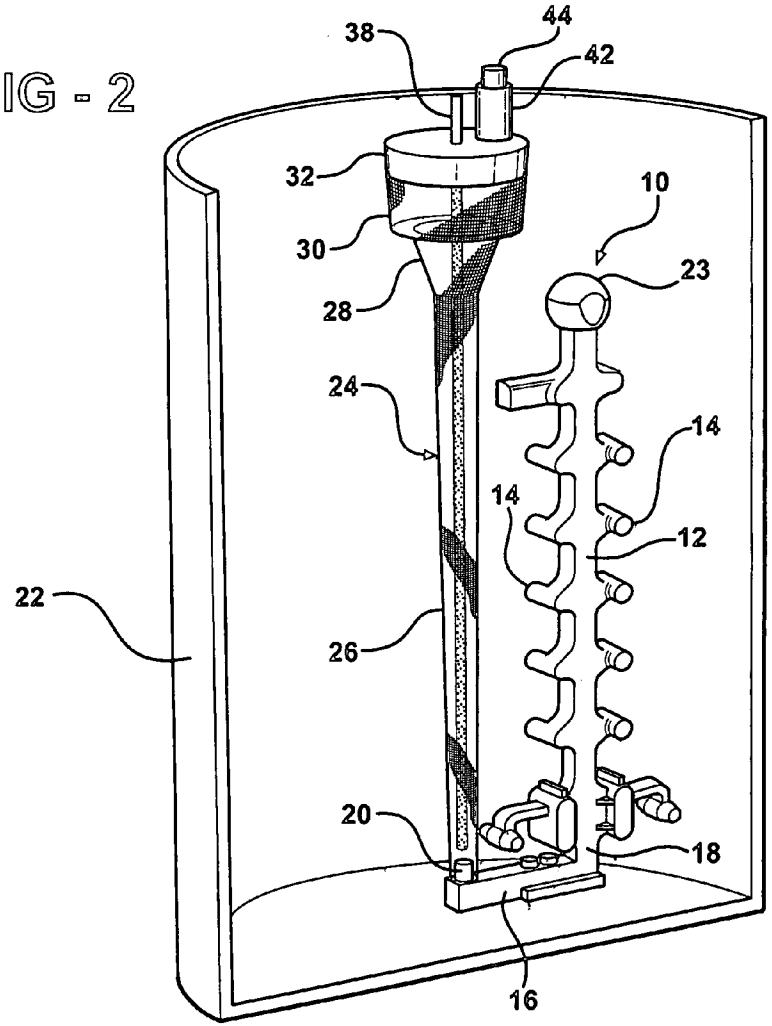
FIG. 2 is a partial perspective view showing a lost foam casting flask in section with the flask housing a sprue forming insert and including the foam gating illustrated in FIG. 1, according to an embodiment of the invention.

FIG. 2 shows a lost foam casting flask 22 which houses the pattern 10 illustrated in FIG. 1 and a sprue forming insert 24. The insert 24 includes an elongate hollow stem member 26, a frustoconical transition member 28, an inlet member 30, and a cover 32. A first end of the stem member 26 is adapted to receive the protuberance 20 therein. The insert 24 extends upwardly from the protuberance 20 substantially parallel to the pattern 10 to a point vertically above the pattern 10.

Figure 4:
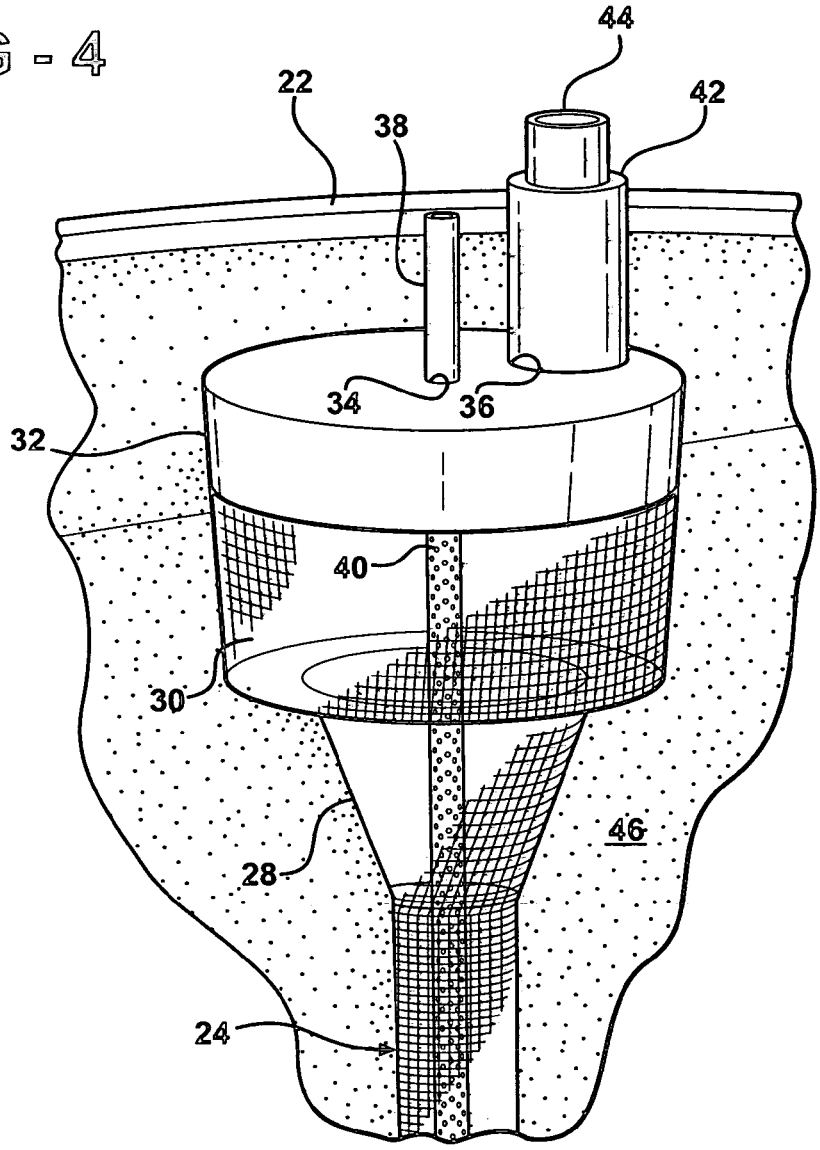
FIG. 4 is an enlarged perspective view of an inlet portion of the insert illustrated in FIGS. 2 and 3.

The transition member 28 is disposed on a second end of the stem member 26 and flares radially outwardly and upwardly therefrom. The inlet member 30 is disposed on and is in communication with the transition member 28. The cover 32 is disposed on the inlet member 30. A first aperture 34 and a second aperture 36 are formed in the cover 32, as clearly illustrated in FIG. 4. The first aperture 34 is adapted to receive a perforated hollow tube 38 therein. By perforated, it is meant that a plurality of apertures 40 is formed in a wall forming the tube 38, or the wall forming the tube 38 is formed by a structure facilitating the distribution of a coating therethrough in a desired manner, for example. The tube 38 extends through the first aperture 34 and substantially the entire length of the insert 24. The apertures 40 are formed in a portion of the tube 38 disposed within the insert 24.

An inlet 42 is disposed in the second aperture 36 and extends axially outwardly therefrom. The inlet 42 includes an adapter 44 adapted to be connected to a source of a catalyst (not shown). In the embodiment shown, the stem member 26, the transition member 28, and the inlet member 30 of the insert 24 are formed by a porous material which permits a fluid to pass therethrough. Any conventional porous material such as a screen, a perforated sheet material, or other porous material, for example, can be used to form the stem member 26, the transition member 28, and the inlet member 30.

Figure 3:
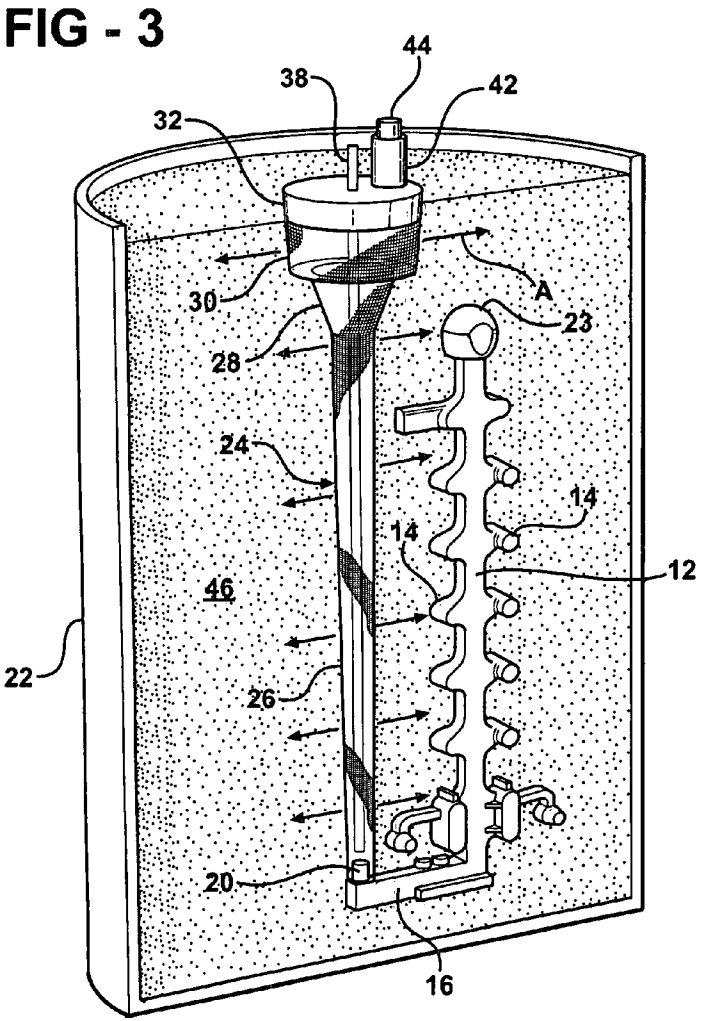
FIG. 3 is a perspective view of the flask, the insert, and the foam gating illustrated in FIG. 2 with the insert and the foam gating embedded in sand within the flask, the flask and the sand shown in section.

In FIG. 3, the casting flask 22 is shown with unbonded sand 46 compacted around and embedding the pattern 10 and the insert 24. Pouring and compacting of the sand 46 in the casting flask 22 is well known in the art. The cover 32 is exposed from the sand 46 facilitating access to the tube 38 and the inlet 42.

To assemble the structure shown in FIG. 3, the pattern 10 is provided using known forming and coating methods. The protuberance 20 is uncoated. It is understood that a coating can be applied to the entire pattern 10, including the protuberance 20, and then the coating removed from the protuberance 20, or the protuberance 20 can be masked or otherwise protected from being coated during the coating process used to coat the remainder of the pattern 10. The insert 24 is provided as shown and described herein. The pattern 10 is assembled with the insert 24 in the configuration shown in FIGS. 2 and 3. The casting flask 22 is provided and the assembled pattern 10 and insert 24 are placed in the casting flask 22. It is understood that the pattern 10 and the insert 24 can be assembled in the casting flask 22, if desired.

Unbonded sand 46 is provided and placed in the casting flask 22 to surround the pattern 10 and the insert 24. The sand 46 is compacted to maintain the configuration of the pattern 10 and the insert 24. It is understood that additional patterns 10 and additional inserts 24 can be positioned in the casting flask 22 as desired to facilitate forming of multiple castings and provide for efficient pouring of the multiple castings.

Figure 5:
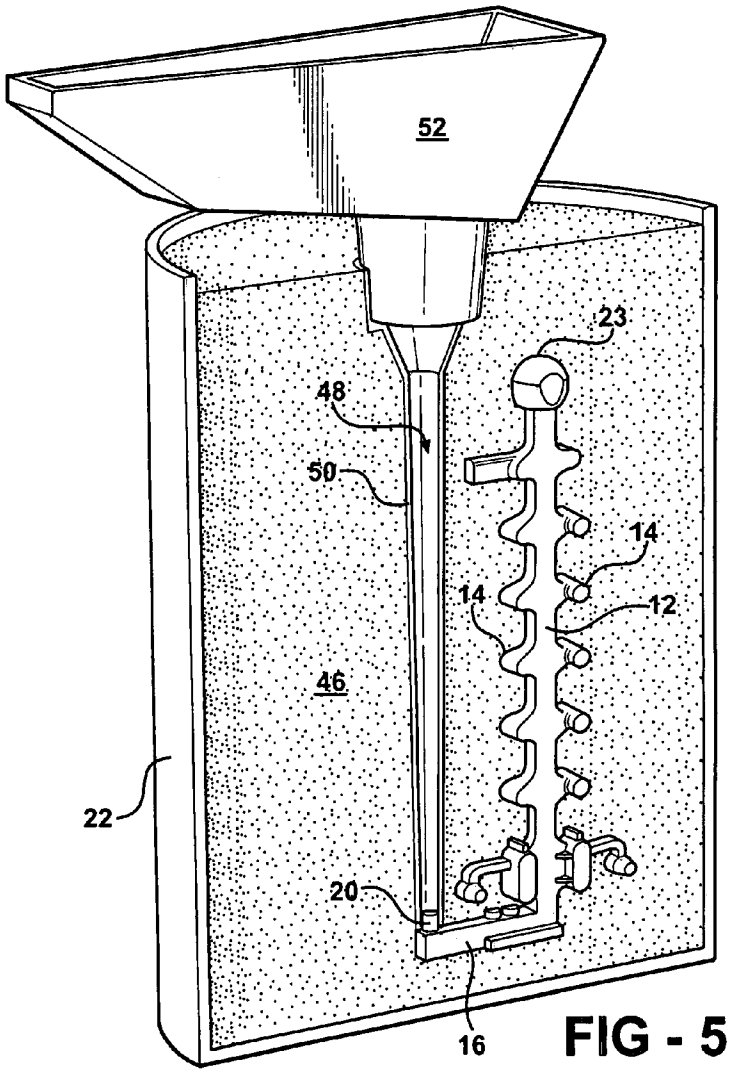
FIG. 5 is a partial perspective view of the flask and foam gating illustrated in FIGS. 2–4 after removal of the insert and insertion of a basin into the sprue, and prior to pouring of the molten metal into the sprue.

The tube 38 is then inserted in to the first aperture 34 to extend into the insert 24 as shown. A source of resin (not shown) is then connected to the tube 38. Any conventional resin can be used which maintains the sand wall shape under the heat and pressure of the molten metal. The resin is caused to flow into the tube 38 and is expelled from the apertures 40 of the tube 38. The resin passes through the porous material which forms the insert 24 and penetrates the sand 46 surrounding the insert 24, as generally depicted by the arrows 'A'. The source of catalyst is connected to the inlet 42 and caused to flow into the insert, through the porous material, and into contact with the resin sprayed into the sand 46. The catalyst causes the resin to cure and harden to create a bonded sand layer 50 surrounding the insert 24. The insert 24 is withdrawn from the sand 46 in the casting flask 22, leaving a sprue 48 formed in the sand 46, as shown in FIG. 5. It is understood that the resin can be cured or bonded by other means such as heat, for example, without departing from the scope and spirit of the invention.

A pouring basin 52 is provided and inserted into the sprue 48 formed by the inlet member 30. Molten metal (not shown) is provided from an overhead ladle or furnace, for example, and poured into the basin 52. The molten metal is directed downwardly through the sprue 48 and into contact with the uncoated protuberance 20. The heat from the molten metal pyrolizes the protuberance 20, thus permitting the molten metal to advance to the horizontal runner 16, the heat from the molten metal then pyrolizing the foam therein. The molten metal is then introduced into the sprue 12, gates 14, and the remainder of the pattern 10, to melt, pyrolyze, and displace the pattern 10. The riser 23 receives the molten metal therein and supplies the molten metal back to the gates 14 to account for shrinkage during cooling and solidification of the casting after pouring of the molten metal.

Gaseous and liquid decomposition/pyrolysis products escape through the gas-permeable, refractory material used to coat the pattern 10 and into the interstices between the unbonded sand 46 particles. The amount of pyrolized gases caused to be directed back into the molten metal is minimized, thereby minimizing turbulence created in the molten metal and defects resulting therefrom in the casting.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An insert for forming a sprue comprising:

an elongate hollow stem member having a first end and a second end, the first end of said stem member adapted to abut a lost foam casting pattern, at least a portion of said stem member is formed by a porous material to facilitate passage of a fluid therethrough;

means for expelling a fluid disposed in said stem member, said means for expelling a fluid adapted to be connected to a source of resin, wherein the resin is expelled by said means for expelling a fluid and passes through the porous material of said stem member; and an inlet member formed by a porous material and disposed on the second end of said stem member, said inlet member having a cover disposed thereon, wherein the cover includes a first aperture and a second aperture formed therein, the first aperture is adapted to receive said means for expelling a fluid, and said second aperture includes an inlet disposed therein.

2. The insert according to claim 1, wherein said means for expelling is a perforated tube member.

3. The insert according to claim 1, wherein the inlet of the cover is adapted to be connected to a source of a catalyst, and the catalyst is caused to flow into said stem member and outwardly through the porous material to cure the resin.

4. The insert according to claim 1, further comprising a frustoconical transition member formed by a porous material, said transition member disposed between said inlet member and said stem member.

5. The insert according to claim 1, wherein the first end of said stem member abuts a horizontal runner of the lost foam casting pattern.

6. The insert according to claim 5, wherein the horizontal runner includes an uncoated foam protuberance, said stem member adapted to receive said protuberance therein.

7. The insert according to claim 1, wherein at least a portion of said stem member is formed by at least one of a screen and a perforated sheet.

8. A mold assembly comprising a lost foam casting pattern and an insert for forming a sprue comprising:

an elongate hollow stem member having a first end and a second end, the first end of said stem member abutting said lost foam casting pattern, at least a portion of said stem member formed by a porous material to facilitate passage of a fluid therethrough;

a perforated tube member disposed in said stem member, said tube member adapted to be connected to a source of resin, wherein the resin is caused to be expelled from said tube member and passes through the porous material of said stem member; and an inlet member formed by a porous material and disposed on the second end of said stem member, said inlet member adapted to receive said tube member.

9. The insert according to claim 8, further comprising a cover disposed on said inlet member, wherein said cover includes a first aperture formed therein, the first aperture is adapted to receive said tube member therein.

10. The insert according to claim 9, wherein said cover includes a second aperture formed therein, the second aperture having an inlet disposed therein, wherein the inlet is adapted to be connected to a source of a catalyst, and the catalyst is caused to flow into said stem member and outwardly through the porous material.

11. The insert according to claim 8, further comprising a frustoconical transition member formed by a porous material, said transition member disposed between said inlet member and said stem member.

12. The insert according to claim 8, wherein the first end of said stem member abuts a horizontal runner of the lost foam casting pattern.

13. The insert according to claim 12, wherein the horizontal runner includes an uncoated foam protuberance, said stem member adapted to receive said protuberance therein.

14. The insert according to claim 8, wherein at least a portion of said stem member is formed by at least one of a screen and a perforated sheet.

15. A method of forming a sprue comprising the steps of:

providing a formed and coated lost foam casting pattern;

providing an insert for forming a sprue comprising an elongate hollow stem member with a first end and a second end, at least a portion of said stem member formed by a porous material to facilitate passage of a fluid therethrough, the insert further comprising means for expelling a fluid disposed in the stem member, the means for expelling a fluid connected to a source of resin;

providing a lost foam casting flask;

positioning the lost foam casting pattern and the insert in the casting flask, wherein the insert abuts the lost foam casting pattern to cooperate with the lost foam casting pattern to define a flow path for molten metal through the casting flask;

providing unbonded sand and at least partially filling the casting flask with the sand and compacting the sand around the lost foam casting pattern and the insert;

causing the resin to flow through the means for expelling a fluid into the insert, through the porous material, and into the sand compacted around the insert;

curing the resin to create a bonded sand layer; and withdrawing the insert from the sand leaving a sprue formed in the sand, the sprue lined by the bonded sand layer.

16. The method according to claim 15, wherein the resin is cured using a catalyst.

17. The method according to claim 15, wherein the resin is cured using heat.

18. The method according to claim 15, wherein at least a portion of the stem member is formed by at least one of a screen and a perforated sheet.

* * * * *